US007049728B2

(12) United States Patent
Bastholm

(10) Patent No.: US 7,049,728 B2
(45) Date of Patent: May 23, 2006

(54) ADJUSTABLE CONSTRUCTION PREFERABLY AN ARTICLE OF FURNITURE AND A SQUEEZE PROTECTION AND A DRIVE UNIT THERETO

(75) Inventor: Jeppe Bastholm, Sønderborg (DK)

(73) Assignee: Linak A/S, Nordborg (DK)

( * ) Notice: Subject to any disclaimer, the term of this patent is extended or adjusted under 35 U.S.C. 154(b) by 162 days.

(21) Appl. No.: 10/497,690

(22) PCT Filed: Dec. 13, 2002

(86) PCT No.: PCT/DK02/00855

§ 371 (c)(1),
(2), (4) Date: Jun. 4, 2004

(87) PCT Pub. No.: WO03/056976

PCT Pub. Date: Jul. 17, 2003

(65) Prior Publication Data

US 2005/0012430 A1 Jan. 20, 2005

(30) Foreign Application Priority Data

Dec. 13, 2001 (DK) ..... 2001 01871

(51) Int. Cl.
*H01L 41/09* (2006.01)
*H02N 2/06* (2006.01)

(52) U.S. Cl. ..... 310/317; 310/328

(58) Field of Classification Search ..... 310/316.01, 310/317, 328
See application file for complete search history.

(56) References Cited

U.S. PATENT DOCUMENTS 3,830,103 A * 8/1974 Andrejkovics et al. ..... 73/7
6,799,523 B1 * 10/2004 Cunha ..... 108/108

FOREIGN PATENT DOCUMENTS

DE 19957187 * 5/2001
JP 63-251368 * 10/1988

* cited by examiner

*Primary Examiner*—Thomas M. Dougherty
(74) *Attorney, Agent, or Firm*—Dykema Gossett PLLC

(57) ABSTRACT

In adjustable structure with a drive unit (8), e.g., an actuator driven by an electric motor and controlled via a control unit, a jamming protection arrangement is needed in certain connections. A solution is provided to a jamming protection arrangement, based on a piezo element (20) incorporated in the structure, alternatively in the drive unit. The piezo element is connected with the control unit, which is constructed such that the drive unit is stopped or reversed if a deviation occurs in the force on the adjustable element (5) or the structure.

21 Claims, 6 Drawing Sheets

Figure 1:
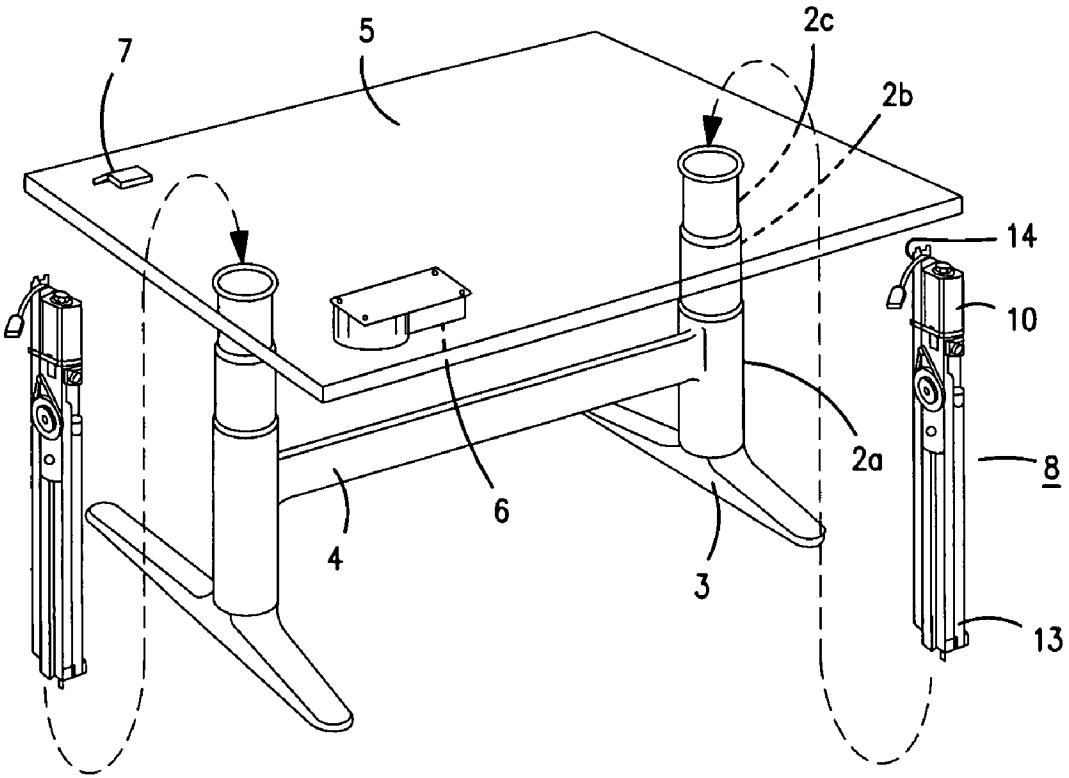

ADJUSTABLE CONSTRUCTION PREFERABLY AN ARTICLE OF FURNITURE AND A SQUEEZE PROTECTION AND A DRIVE UNIT THERETO

The present invention relates to a structure of the type defined in the introductory portion of claim 1 and a jamming protection arrangement as well as a drive unit therefor.

A widely used drive unit for performing adjustments is linear actuators, where an electric motor, via a gearing, drives a spindle having a nut movable in the axial direction to which an activation element is secured, cf. e.g. EP 622 573 B1 to Linak A/S and WO 96/12123 to Dietmar Koch (Okin). A particular form of linear actuators is lifting columns which are typically used for height-adjustable tables. The commercially available lifting columns are typically based on a spindle, but there are also solutions with wire drives and endless chains, cf. e.g. PCT/DK02/00476 to Linak A/S. For the sake of completeness, it should be mentioned that the drive unit may also be a rotary actuator, cf. e.g. WO 01/17401 A1 to Unak A/S.

These actuators find general application, examples of use being for adjustable articles of furniture (e.g. chairs, beds, tables), hospital and nursing equipment (e.g. hospital beds and sickbeds, patient lifters) and industrial equipment (e.g. agricultural machinery, conveyors, process systems, barrier and bar systems) just to mention a few examples.

Performance of an adjustment involves a risk of an object getting into the path of movement of the element, or there might be something in the structure itself that counteracts the movement. In this respect, a distinction is made here between a blocking protection arrangement which is basically aimed at protecting the structure, and a jamming protection arrangement which is basically aimed at protecting an object which inadvertently enters the path of movement of the element. What is in mind here is primarily avoidance of injury to individuals.

For blocking protection, various solutions are known, such as overloading couplings (U.S. Pat. No. 4,846,011), detection of an increase in the motor current or detection of the speed of rotation of either the motor or of the gearing. In many cases the blocking protection is also used in linear actuators, also as an end stop. Mention may here be made of a special structure where a contact arm acts against a spring force, cf. U.S. Pat. No. 4,307,799 to Andco Actuator Products and EP 727 601 to General Electric. The blocking protection thus protects the structure against overloading, while the object getting jammed is exposed to the prescribed maximum load of the structure.

As mentioned, the jamming protection is aimed at protecting the very object that gets jammed. An example of a jamming protection arrangement is provided in WO 01/117400 which relates to a rotary actuator incorporated in a bed.

A particular problem is jamming protection in height-adjustable tables which must ideally be active both when the tabletop is lowered and raised. When the tabletop is raised, it may e.g. hit an adjacent table, a window frame or a shelf. Jamming protection is very important particularly when the table is present in a home with small children.

U.S. Pat. No. 5,495,811 discloses two different solutions, one where the tabletop is arranged loosely in a frame and rests on a contact. If the tabletop meets an obstacle in a downward direction, the tabletop is lifted and the contact is activated to interrupt the current to the motor. Inexpediently, the tabletop rests with its entire weight and load (as a guideline 100 kg) on the object which has got jammed. The solution does not either allow for the fact that the carrying frame hits an obstacle, nor is it active in the upward direction of the tabletop either. The other solution is based on the so-called tape switches which are adhered to the underside of the table. These are not active in the upward direction of the table either.

SE 516 479 C2 to Artektron AB discloses a solution based on a weighing cell in the form of a strain gauge arranged at the back of a U-shaped element. The shown structure exclusively records deviations in the moment load on the tabletop. The drawing indicates a table of the generally used type having a leg at each end located rather close to the rear edge of the tabletop. The front edge of the tabletop thus protrudes a considerable distance forwardly of the legs. This means that a minor change of force at the front edge of the table results in a great change in the moment load, while even a rather great change of force in the area of the leg is not recorded. The legs are typically connected with an architrave to achieve sufficient stability. If by accident a child, e.g. when playing, should get jammed between the architrave and the tabletop, this will not give rise to any special moment load with the consequent risk that the jamming protection arrangement remains inactive. A great vertical load directly on the strain gauge will not give any signal at all, since this does not give rise to a moment load. From an overall point of view, the use of strain gauges involves complicated solutions and moreover has the drawback that they "drift", i.e. they must constantly be calibrated somehow.

The object of the invention is to provide a jamming protection arrangement which primarily offers a more complete protection, and is simpler and easier to incorporate than the previously known ones.

This is achieved according to the invention by a structure which is characterized by comprising a piezo element arranged in connection with one of the attachment points of the drive unit or in the drive unit itself to record deviations in the force extending between the attachment points of the drive unit. Thus, the piezo element is not used for making absolute measurements, but exclusively for recording deviations on the basis of concrete situations. The absolute force to be moved by the drive unit may basically be different from time to time, which is of minor importance. The essential point is that during movement the piezo element records deviations in the initial load to indicate that the adjustment element meets an obstacle and then stops/reverses the motor. Limit values may be fixed as to how great deviations of the force may be tolerated before this is taken to mean that the structure meets an obstacle.

In this connection it is particularly expedient that transient signals from the piezo element are ignored or suppressed during starting of the drive unit to eliminate the special forces that occur during start. This may be the transition from static to dynamic function, overcoming of forces of inertia, or a "binding"/"rooting" when the structure has been at a standstill, and similar forces. Of course, the time of using the signal from the piezo element may be adapted to the actual structure, force application and speed at which the drive units runs. It will be appreciated that the transient phenomenon is quite brief (typically milliseconds), so that in reality there will be no time for jamming to occur.

In this connection it is noted that the controls are typically, but not exclusively microprocessor-based, thereby allowing desired threshold and limit values to be incorporated in terms of software. In case of controls not based on microprocessors, threshold and limit values may be provided electronically.

In case of height-adjustable tables, e.g., the force may be varied by removing or putting an object on the table. When the height of the table is adjusted, the force may be different from time to time, which is of minor importance. With the given initial load (force), the piezo element will exclusively record deviations in the force during the adjustment itself, if the table top meets an obstacle in a downward or upward direction.

The solution of the invention is also independent on how the load is distributed on the adjustable element, e.g. on a tabletop there are typically local loads e.g. in the form of a computer, stacks of paper, etc. The essential point is exclusively the resulting force on the piezo element.

The type of the piezo element is adapted to the structure concerned, but it has been found to be particularly expedient to use a passive sound generator containing a piezo element. These are generally known and are widely used for emitting a brief sound, e.g. the well-known beep sounds in the operation of electronic apparatuses. The passive sound generator is advantageous in that the piezo element is arranged on a thin, flexible disc of metal, so that a useful signal will be obtained even with the application of a relatively low force. Relative to a ceramic disc or block-shaped piezo element which is to be specially designed for the given purpose, the passive sound generator is a general and inexpensive component.

To avoid destruction of the piezo element by overloading, mechanical stops may be incorporated in the structure which limit the travel of the piezo element.

Further, the structure may be formed with a gearing so that just a minor directly proportional part of the load is transferred to the piezo element. Such a gearing might be sets of springs, where one set is in contact with the piezo element and has a spring constant smaller than the other set of springs between the stationary and movable parts of the structure. It will be appreciated in this connection that the drive unit may be associated fully or partly with the one or the other part.

The location of the piezo element(s) is adapted to the structure concerned. In connection with the attachment of the drive unit, a piezo element might be provided which recorded any change in the force on the drive unit. In height-adjustable tables, a piezo element might be arranged below each leg. In tables having a cross member between the legs, however, it should be positioned so as to allow avoidance of jamming between the tabletop and the cross member. Expediently, the pressure transducer is arranged in the line of force between the attachment points of the drive unit, thereby achieving the most direct impact on the piezo element.

Particularly expediently, the piezo element is incorporated in the drive unit, viz. in connection with a force absorbing bearing in the actuator. Hereby, the drive unit may be supplied as a finished and thoroughly tested unit, which obviates separate subsequent mounting of the piezo element in the structure and the consequent drawbacks.

How the braking is to take place may be adapted to the structure concerned, just as it may be decided whether reversing of the drive unit is to be carried out. A simple and safe solution is short-circuiting of the motor windings. If rapid stopping of the drive unit is required, the control may be adapted such that the rotation of the motor is turned so as to provide active braking. It may then be decided whether reversing proper of the drive unit is to take place. Also, a brake proper may be incorporated in the drive unit or overall in the structure, e.g. a type which is activated by a solenoid.

As stated in claim 20, the invention also relates to a jamming protection arrangement as defined in claims 1–19 and constructed as a separate unit, and, as stated in claim 21, the invention moreover relates to a drive unit with an incorporated or mounted jamming protection unit as defined in claims 1–20.

Figure 2:
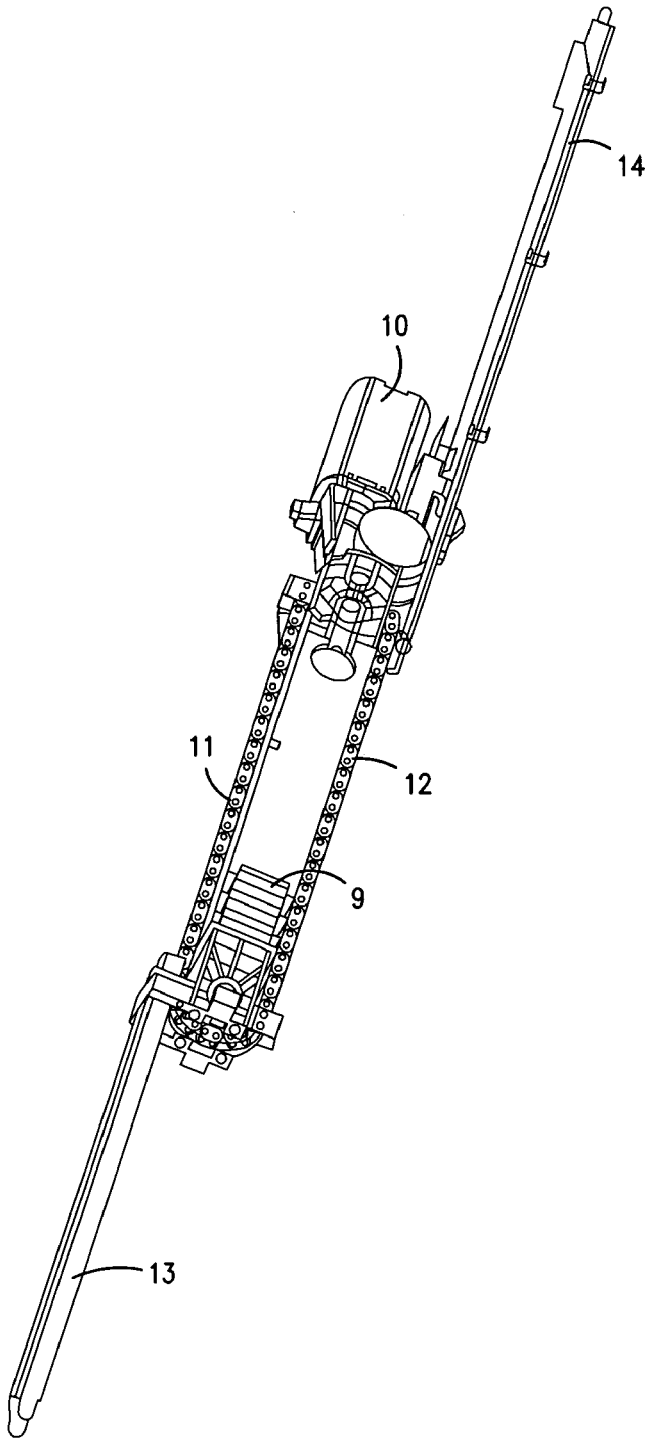
Figure 3:
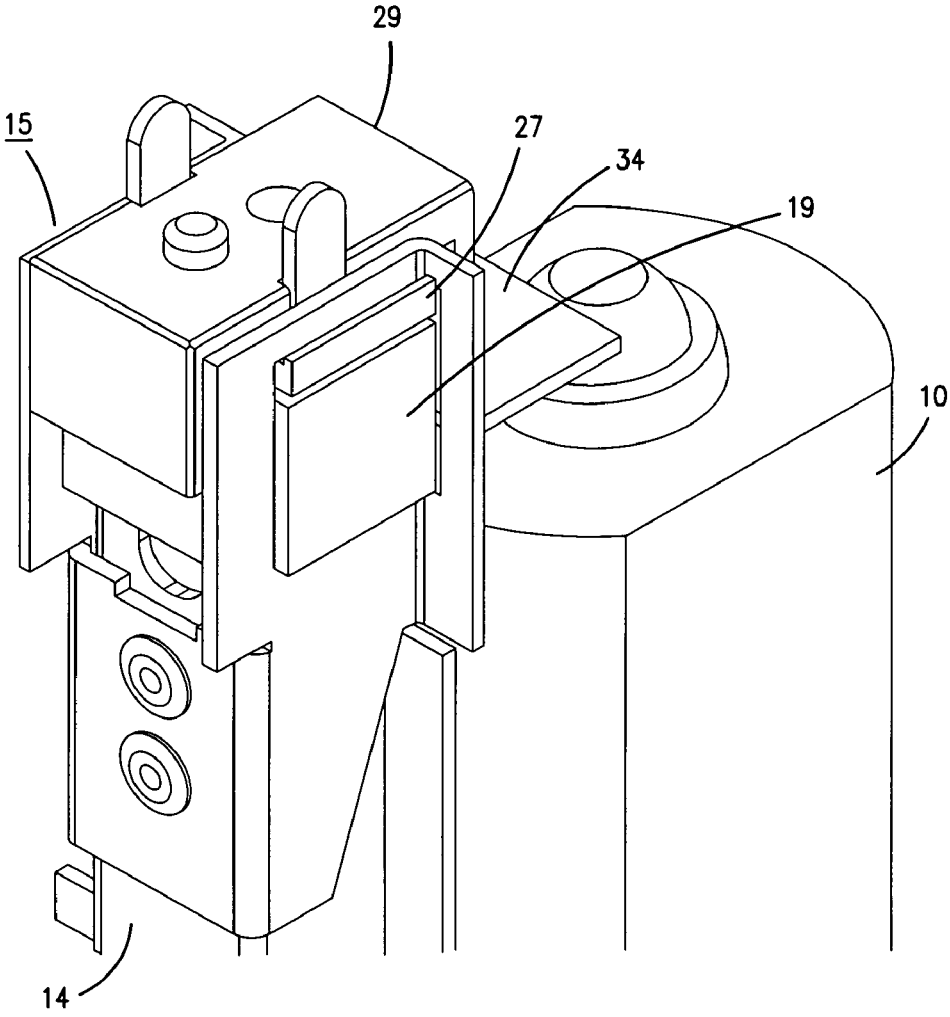
Figure 4:
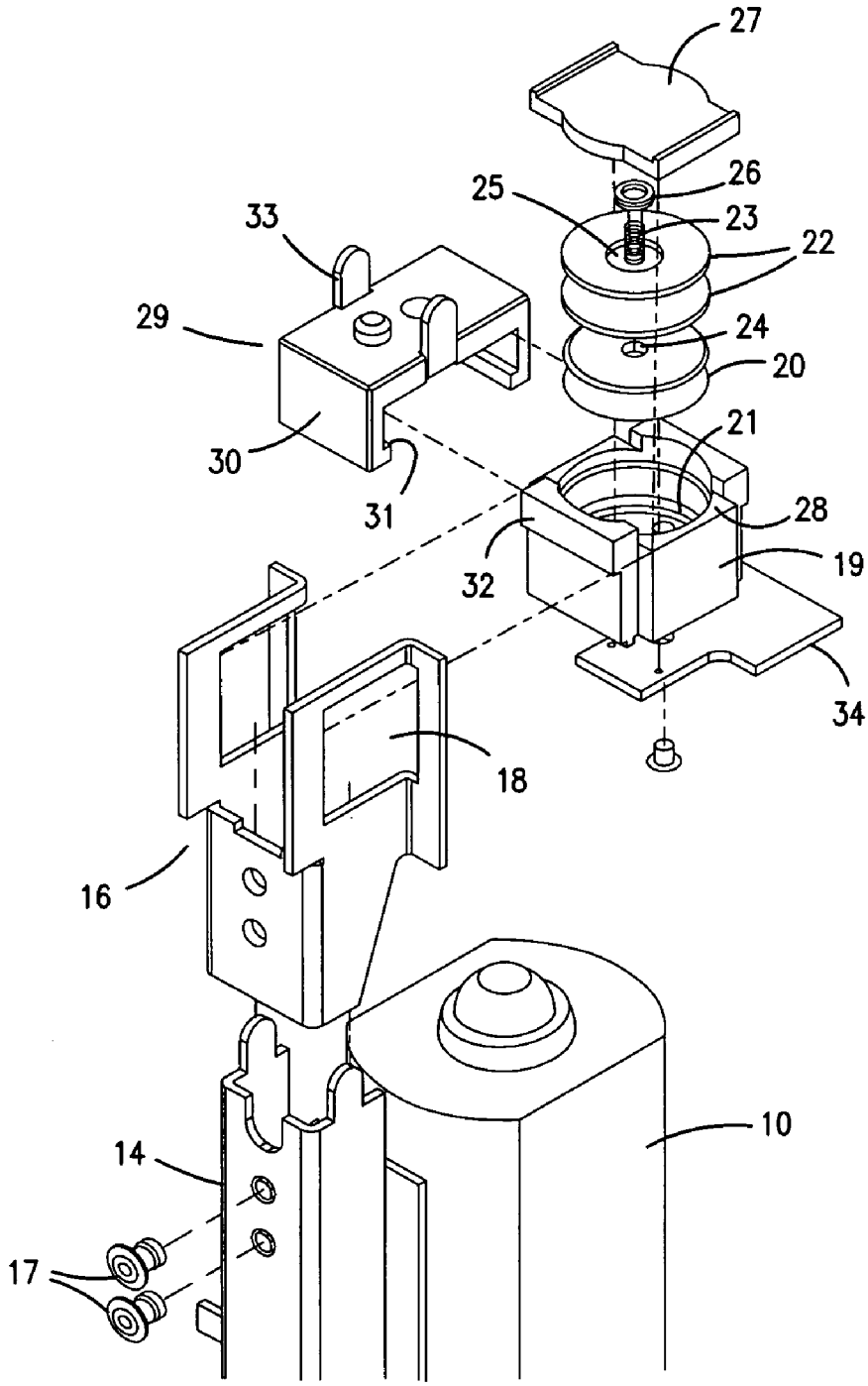
Figure 5:
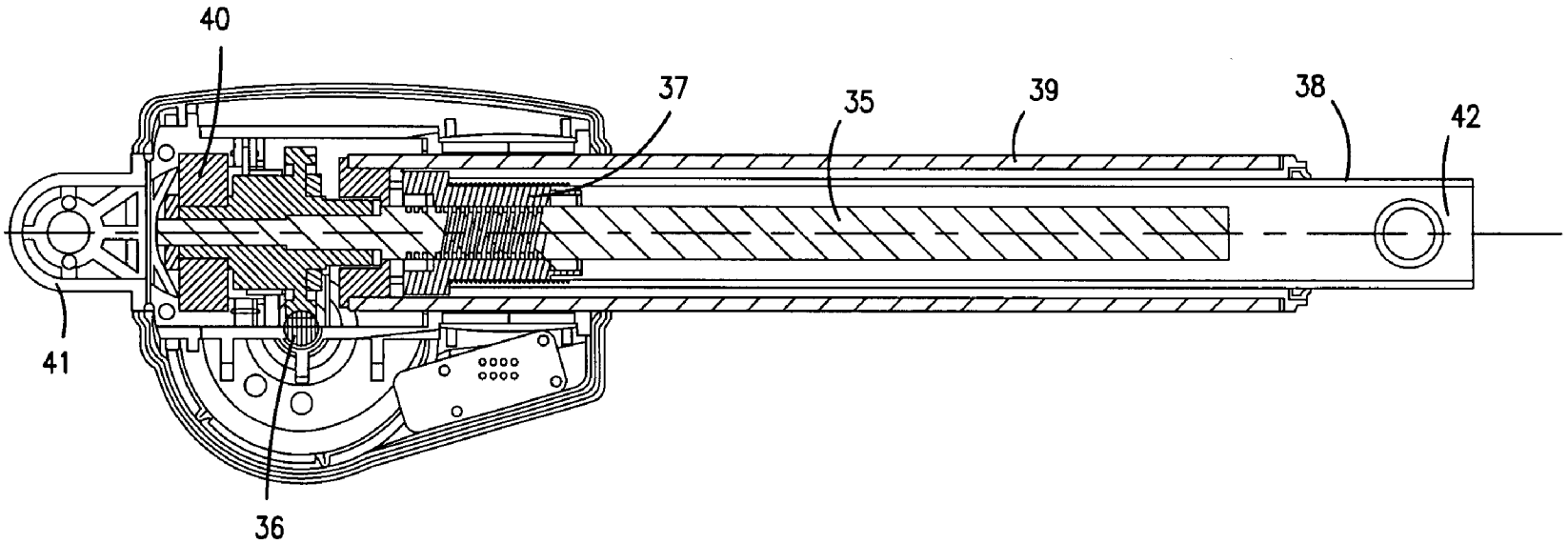
Figure 6:
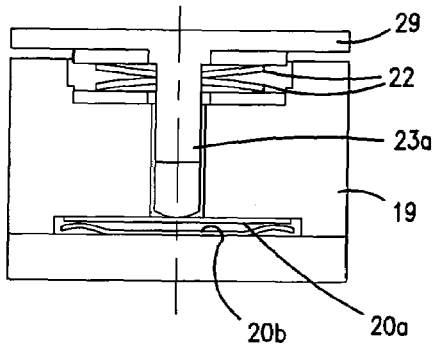
Figure 7:
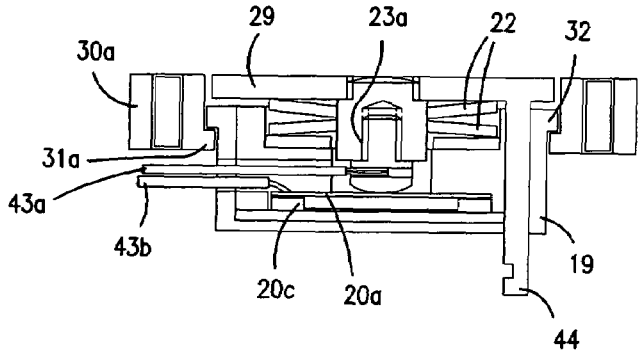
Figure 8:
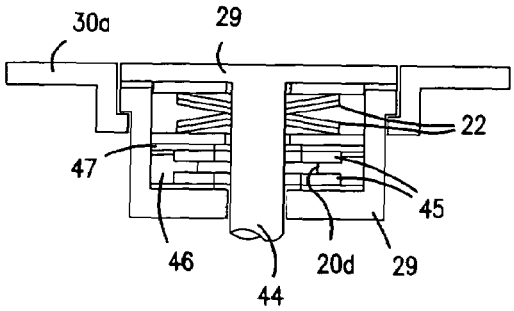

An embodiment of the invention in the form of a height-adjustable table will be explained more fully below with reference to the accompanying drawing. In the drawing:

FIG. 1 shows a schematic view of a height-adjustable table, where the tabletop is shown transparent, and with the drive units shown separate in a retracted state, FIG. 2 shows a drive unit In a fully extended state, FIG. 3 shows a jamming protection unit with a piezo element mounted on the outer end of the upper rod in the drive unit, FIG. 4 shows an exploded view of the jamming protection unit with a piezo element shown in FIG. 2, FIG. 5 shows a longitudinal section through a linear actuator, FIG. 6 shows a cross-section through another embodiment of the invention, FIG. 7 shows a cross-section through an embodiment similar to the one of FIG. 6, and FIG. 8 shows a cross-section through a further embodiment of the invention.

The desk shown in FIG. 1 comprises a lifting column 1 at each end. The lifting column 1 consists of three mutually telescopic members 2*a*, 2*b*, 2*c* and are firmly mounted in a foot 3 with the lower end of the outer member 2*a*, which is connected with a cross member 4 at the upper end. The tabletop 5 is mounted on the upper end of the inner member 2*c* of the lifting columns.

The movement of the columns is caused by an incorporated drive unit 8, which is driven by an electric motor which is connected with a control box 6 with a power supply. The box also contains a control which is activated by a control panel 7 arranged at the front edge of the table. The control may be based on rotary potentiometers, optical or magnetic encoders for determining the height of the tabletop or purely electronically, as stated in WO 02/091539.

The drive unit 8 is of the type which is defined in the applicant's international application PCT/DK02/00467, which is hereby incorporated by reference in the present application.

The structure of the drive unit will now be described briefly for the sake of good order. It is based on a rod-shaped element 9 having a chain which extends around a gear wheel at each end. The one gear wheel is driven via a gearing by a DC motor 10 secured to the end of the rod. A rod 13, 14 is secured to each chain run 11, 12 between the two gear wheels, said rod being secured to the outer member 2*a* and to the inner member 2*c*, respectively. When the motor is activated, the two rods 13, 14 will synchronously extend the outer profile 2*a* and the inner profile 2*c* relative to the intermediate profile 2*b* as a consequence of the movement of the chain and correspondingly retract them when the rotation of the motor is turned. Reference is made to said international application for a more detailed explanation of the drive unit.

As will appear from FIGS. 3 and 4, the end of the rod 14 has mounted thereon a unit 15 containing a passive sound generator with a piezo element. The unit comprises a substantially U-shaped frame 16 which fits over the end of the rod 14 and is secured thereto with a pair of rivets 1. A hous ing 19 having a cylindrical interior may be inserted into an opening 18 of the frame, and a capsule 20 resting on a flange 21 may be accommodated in said housing. The capsule contains a passive sound generator in the form of a thin, circular, elastic metal plate on which a piezo element is arranged, e.g. a kbs-20 db-4p. A pair of disc springs 22 rest above the capsule 20. A screw spring 23 rests with one end on the passive sound generator, said spring 23 extending through a circular recess 24 at the top of the capsule 20 and further through a circular recess 25 in the disc springs and provided at the other end with a pressure shoe 26 having a short control pin, which extends into the spring, and the upper side of the head of the pressure shoe has an engagement bead which is received in a recess in the cover so that it is guided. A cover 27 is arranged on the disc springs 22 and the pressure shoe 26 of the screw spring, said cover being guided in a recess 28 at the top of the housing 19 and with side edges on the upper side for guidance in the recess 18 in the frame 16. The cover 27 is kept in position by a lid 29 which engages below an edge 32 on the housing 19 with a pair of legs 30 terminating with flanges 31 facing toward each other. The length of the legs 30 is adapted such that the lid 29 is allowed to travel. In a non-loaded state, the springs press the cover and thereby the lid 29 upwards, so that the lid grips the flanges 32 on the housing with its edges 31. A U-shaped metal bracket 33 is secured in the lid 29, having two upwardly extending legs for attachment to the inner member 2*c* of the column. This takes place over an end plate by which the column is secured to the table top. The metal bracket thus replaces the two flaps on the rod 14. The jamming protection as a unit may thus be mounted readily on the drive unit without any modifications to the mounting brackets being required. Thus, the drive unit with the jamming protection may thus be mounted selectively. Below the housing 19 there is mounted a small printed circuit board 34 with terminals for the acoustic sound generator and connection to the control 6. As an alternative to the metal bracket, the attachment may be performed with a small guide pin on the lid and a screw, screw holes being indicated at the side of the guide pin.

The spring constant of the screw spring 23 and the disc springs 22 is adapted so that just a small portion of the force is transferred to the screw spring and thereby the acoustic sound generator.

The tabletop rests with its weight on the lid 29, which is carried above the cover 27 by the disc springs 22. It will be appreciated that these springs 22 are dimensioned to carry the weight of the tabletop and the load thereon. If the tabletop meets an obstacle during an upward movement, the force on the springs 22 will be increased, and the force of the screw spring 23 on the acoustic sound generator will be increased correspondingly, thereby signal ling the control 6 to change the force on the tabletop. The control is adapted to stop the drive unit and reverse briefly for retraction (lowering) of the tabletop from the encountered obstacle. If during a lowering movement the tabletop meets an obstacle, this will cause an initial relief, whereby the force of the screw spring 23 on the passive sound generator is relieved, and a change in the force is recorded. The control 6 is then signalled to stop the drive unit 8 and reverse briefly to raise the tabletop, thereby releasing the object which got jammed. It will be appreciated that be tabletop only affects the obstacle with a minor inconsiderable weight, i.e. the tabletop will never hang on the obstacle with its full weight.

If the table should be overloaded with an extreme force, then the mechanical brackets will prevent destruction of the passive sound generator. If the table is loaded strongly from above, the underside of the lid 29 will hit the upper side of the housing 19, and, conversely, if e.g. during moving and handling of the table a strong upwardly directed force is unintentionally applied to the lower side of the tabletop or the legs are pulled, then the flanges 31 on the lid 29 will engage the edges 32 on the housing 19.

It will be appreciated that the invention may also be applied in an actuator of the type defined in the applicant's international application WO 02/29284, which is hereby incorporated by reference in the present application.

With reference to FIG. 5, it will briefly be summarized that the actuator comprises a spindle 35 which is driven by a DC motor via a worm gear 36. The spindle has a nut 37 with an activation element in the form of an inner pipe 38 guided in an outer pipe 39. A compressive bearing 40, in the present case a ball bearing, is arranged on the end of the spindle to absorb the compressive forces occurring on the actuator. With suitable modification, the jamming protection arrangement may be arranged immediately behind the compressive bearing, or in connection with the rear attachment 41 of the actuator, in the alternative at the outer end 42 of the inner pipe 38. The same, of course, applies to actuators which operate under tension, which merely differ by having a tensile bearing instead of a compressive bearing.

As will appear, the invention provides a completely new path for the provision of jamming protection in an adjustable structure or the drive unit which operates it.

FIGS. 6–8 of the drawing show a cross-section of three other embodiments of the invention, and the same parts are designated by the same reference numerals as above. With respect to the embodiment in FIG. 6 it is noted that the passive sound generator comprises a disc 20*a* with a piezo element resting on a disc-shaped spring element 20*b*. The piezo element is here affected directly by a pin 23*a* on the lid 29. It is noted that the pin may very well be formed with an outer spring-loaded, telescopic part so as to achieve a gearing, as described earlier. The housing is here secured to the stationary part of the structure and the lid with the pin to the movable element. The structure may be provided as a unit intended for incorporation, where the housing may e.g. be mounted in a support for a tabletop and the lid with the pin is secured to the lower side of the tabletop. The disc springs 23, here arranged between two washers, carry the weight of the tabletop. In the embodiment shown in FIG. 7, the disc-shaped spring element with the piezo element 20*a* rests on a corrugated disc 20*c*. Connection wires to the piezo element and the pin are indicated at 43*a*, 43*b*. The housing which is circular here, has an annular flange 32 which cooperates with a flange 31*a* on a surrounding ring 30*a*. This ring 30*a* is provided with screw holes for attachment of the ring to the movable part. Here, the lid 29 may be secured to the stationary part by a downwardly extending pin 44. The embodiment shown in FIG. 8 differs in that the piezo element 20*d* is a ring mounted between two discs 45. There is an air gap between a surrounding ring 46 and a disc 47. The pressure from the two disc springs 22 will propagate through the intermediate discs to the piezo element 20*d*.

Disc springs are used in the stated examples, but nothing prevents the use of screw springs, but the disc springs are more suitable in the present examples.

Finally, it should be noted that the jamming protection has no direct relation to end stops in actuators or their quick release function (EP 577 541 B1 to Linak A/S). These functions may occur concurrently with the jamming protection.

The invention claimed is:

1. An adjustable structure, comprising:

a stationary part (1, 3), an adjustable element (5) connected therewith, a drive unit (8) for causing adjustment of the element (5), said drive unit (8) with a movable activation element (14; 38) and another part (13: 41) being secured to the adjustable element and to the stationary part, respectively, said drive unit comprising an electric motor (10) for the driving thereof, a control unit (6) for controlling the drive unit, a sensor (15) connected to the control to currently record deviations in the load on the adjustable element in operation and, in response to this, to signal the control unit to stop/reverse the motor, and wherein the sensor is formed by a piezo element (20) arranged in connection with one of the attachment points of the drive unit (8) or in the drive unit itself to record deviations in the force extending between the attachment points of the drive unit.

2. A structure according to claim 1, wherein the signals from the piezo element are ignored during the start of the drive unit.

3. A structure according to claim 1, wherein the signals from the piezo element are used only when these have found a constant level after the start of the drive unit.

4. A structure according to claim 1, wherein the piezo element is positioned at a location in the line of force between the attachment points of the drive unit.

5. A structure according to claim 1, wherein the piezo element is arranged in connection with a force absorbing bearing (40) in the drive unit.

6. A structure according to claim 1, comprising a passive sound generator (20) containing a piezo element as a sensor.

7. A structure according to claim 1, comprising mechanical stops (31, 32; 29, 19) which limit travel of the piezo element.

8. A structure according to claim 1, comprising gearing so that just a minor directly proportional part of the force is transferred to the piezo element.

9. A structure according to claim 8, wherein the gearing comprises a set of springs, where one spring (23) is in contact with the piezo element and has a spring constant smaller than another spring (22) between the stationary and movable parts of the structure.

10. A structure according to claim 8, the spring (22) is formed by disc springs, while the spring (23) is formed by a screw spring.

11. A structure according to claim 9 wherein the spring (22) is dimensioned to carry the weight of the movable part and the maximum weight which the part is intended to be capable of carrying.

12. A structure according to claim 10, wherein a jamming protection arrangement is provided as a unit comprising a housing (19) which accommodates the piezo element (20).

13. A structure according to claim 12, wherein the housing (19) comprises a lid (29) with legs (30) formed with abutments (31) for cooperation with abutments (31) on the housing to limit travel of the lid.

14. A structure according to claim 13, wherein the springs (22, 23) are accommodated in the housing, and at that the spring (22) pushes the lid (29) away from the housing.

15. A structure according to claim 12, wherein the jamming protection arrangement comprises a frame (16) for the housing (19).

16. A structure according to claim 15, wherein the housing (19) is received in a recess (18) in the frame.

17. A structure according to claim 12, wherein the jamming protection arrangement comprises a printed circuit board (34) for the connection of the piezo element and for the connection of the control (6).

18. A structure according to claim 12, wherein the jamming protection arrangement is provided with mounting brackets for the mounting of the movable element (15).

19. A structure according to claim 12, wherein the jamming protection arrangement is mounted on the end of the activation element (14; 38) of the drive unit.

20. A jamming protection arrangement as defined in claim 12, configured as an independent unit.

21. A drive unit having an incorporated or mounted jamming protection arrangement as defined in claim 12.

* * * * *